US006261174B1

(12) United States Patent
Kuehn

(10) Patent No.: US 6,261,174 B1
(45) Date of Patent: Jul. 17, 2001

(54) AIR FLOW CONTROL APPARATUS AND METHOD

(76) Inventor: Thomas C. Kuehn, 2500 W. Appletree Rd., Glendale, WI (US) 53209

( * ) Notice: Subject to any disclaimer, the term of this patent is extended or adjusted under 35 U.S.C. 154(b) by 0 days.

(21) Appl. No.: 09/207,569

(22) Filed: Dec. 8, 1998

(51) Int. Cl.[7] ..... F24F 13/10
(52) U.S. Cl. ..... 454/290; 454/306
(58) Field of Search ..... 454/231, 290, 454/306, 322, 325, 333, 335

(56) References Cited

U.S. PATENT DOCUMENTS

| | | | | |
|---|---|---|---|---|
| 699,183 | | 5/1902 | Jones . | |
| 782,708 | | 2/1905 | Symonds . | |
| 1,542,178 | | 6/1925 | Ross et al. . | |
| 1,826,607 | | 10/1931 | Eiben . | |
| 2,897,742 | | 8/1959 | Ryburn et al. . | |
| 4,850,266 | | 7/1989 | Bennett | 454/306 |
| 5,238,452 | * | 8/1993 | Levy et al. | 454/306 |

FOREIGN PATENT DOCUMENTS

| | | | | |
|---|---|---|---|---|
| 55-41354 | * | 3/1980 | (JP) | 454/306 |
| 6-193952 | * | 7/1994 | (JP) | 454/306 |

OTHER PUBLICATIONS

"Home Trends" Catalog (pp. 6–8; 1999).

* cited by examiner

*Primary Examiner*—Harold Joyce
(74) *Attorney, Agent, or Firm*—Boyle, Fredrickson, Newholm, Stein & Gratz S.C.

(57) ABSTRACT

An apparatus for controlling a flow of air from an air supply into a room having a floor, a ceiling, a wall, and a vertically extending passage disposed in the wall that communicates with the air supply and that extends from adjacent the floor to adjacent the ceiling includes an upper outlet disposed adjacent the ceiling that is in communication with the passage. In addition, the apparatus includes a lower outlet formed in the wall and disposed adjacent to the floor. The lower outlet is in communication with the passage and includes a first damper disposed in the passage that is movable between a closed position impeding air from flowing out the lower outlet and into the room, and an open position disposed from the closed position permitting air from the air supply to flow through the lower outlet into the room. The lower outlet additionally includes a second damper disposed in the passage that is movable between a closed position impeding air from the air supply from flowing farther up the passage toward the upper outlet, and an open position disposed from the closed position that permits air from the air supply to flow farther up the passage to the upper outlet.

34 Claims, 6 Drawing Sheets

AIR FLOW CONTROL APPARATUS AND METHOD

FIELD OF THE INVENTION

The present invention pertains to an air flow control apparatus and more particularly to devices for regulating the flow of hot and cold air into a room.

BACKGROUND OF THE INVENTION

Registers for controlling the flow of air into a room are well known and typically include a frame having a number of vents through which air is dispensed into the room. In addition, the register typically includes a damper that is connected to the body by a manually controllable lever that allows the user to open and close the register. A typical building, such as a home, will have many such registers for dispensing air into particular rooms and, by selectively opening and closing certain registers throughout the home, the user can control which rooms receive conditioned air. Such registers often are located near the bottom of the wall, such that air is dispensed near the floor of the room. Although preferred when providing warm conditioned air, such an arrangement inefficiently dispenses cool conditioned air.

It is generally known that dispensing cool air near the ceiling of a room results in more efficient distribution of cool conditioned air, but known systems that implement such a feature are bulky, inefficient, expensive, and unattractive. For example, one known system disclosed in U.S. Pat. No. 4,850,266 includes a central air uptake attachment having a housing with upper and lower outlets. Together with the interior-facing side of a room wall, the housing defines an internal chamber for channeling air from the room wall air outlet to the upper and/or lower outlets. The housing must be glued to the wall or sealed in some other fashion to prevent air flow from escaping at the seams of the apparatus, thus making removal and/or repositioning of the apparatus difficult. And, when mounted, the housing unattractively protrudes into the room, thus inconveniently occupying a portion of the room. Moreover, such a system is limited as it really is only effective where a room has a floor vent.

In addition to its burdensome construction, such a system exhibits unacceptable levels of conditioned air losses, whether warm or cool air is desired. For example, imperfect seals between the apparatus and the wall can lead to inefficient distribution of cool air near the floor of the room. Further, because the conditioned air travels through an additional duct that is located away from the existing main air carrying passage of the building, losses are realized due to the long journey that the air must complete prior to being dispensed into the room. Losses can result from stagnating air within the uptake channel as well as in the main air carrying passage. Overall, because the upper and lower outlets are disposed away from the wall and spaced from the room wall air outlet, this bulky and relatively expensive apparatus, including the uptake attachment, disadvantageously provides inefficient communication of air between the air supply and the room.

As a result, the field of air flow control devices is in need of a self-contained apparatus that is retrofittable to an existing air dispensing outlet formed in a wall, is easy to operate and relatively inexpensive to manufacture. In addition, an apparatus is desired that efficiently distributes both hot and cold air into the room throughout existing outlets, the outlets preferably being situated at or near the floor and ceiling of the room.

What is needed is an apparatus that can selectively and efficiently distribute cool air near the top of the room when cooling is desired and hot air near the bottom of the room and which is integral with the wall in which it is mounted. What is further needed is an apparatus that has a bottom register that utilizes more than one damper to provide a better seal to minimize air flow losses during operation.

SUMMARY OF THE INVENTION

An air flow control apparatus that includes an air supply in communication with a lower air outlet that is a flow controller that has a pair of independently manipulable air diverters and an upper air outlet with the outlets both integrally mounted in the wall and interconnected by a passage formed within the wall. One of the air diverters is an outlet diverter that can be moved between a closed position to prevent air from the supply from flowing out the lower outlet into the room and an open position that allows air from the supply to flow out the lower outlet into the room near the floor. The other of the air diverters is a passage diverter that can be moved between a closed position to prevent air from the supply from flowing through the passage to the upper outlet and an open position that permits air from the supply to flow through the passage to the upper outlet where it can be introduced into the room near the ceiling. The supply typically comprises a forced-air heater, such as a gas heater, an LP heater or the like, that has a duct, typically made of metal or plastic, that extends from the heater to the room equipped with the air flow control apparatus.

The lower outlet preferably has three diverter position settings. In a first setting, typically used for heating the room, the outlet diverter is located in its open position and the passage diverter is located in its closed position to permit air to flow out the lower outlet while preventing air flow to the upper outlet. Preferably, when in its fully open position, the outlet diverter also prevents air flow to the passage providing a seal that impedes air flow and which is redundant to that of the passage diverter.

In a second setting, typically used for cooling the room, the outlet diverter is located in its closed position to prevent air flow out the lower outlet and the passage diverter is located in its open position to permit air to flow through the passage to the upper outlet. In a third setting, typically used for blocking all air flow to the room, the diverters are both disposed in their closed position.

The lower outlet preferably comprises a register that has a frame or housing which includes a perforate grill that preferably is comprised of a plurality of pairs of spaced apart louvers or slots through which air can flow. The lower outlet also has an inlet port in the wall that is in air-flow communication with the supply and an outlet port in the wall that is in air-flow communication with the passage leading to the upper outlet. The diverters preferably each comprise a damper attached to a lever, pivotally coupled to the frame, that is manually grasped and manipulated during use.

The upper outlet can also comprise a register that preferably is equipped with an outlet diverter or damper but need not be equipped with any diverter or damper. The upper outlet has a frame that includes a perforate grill and an inlet port within the wall that is in air-flow communication with the passage. The upper outlet preferably has a cap or the like within the wall that blocks air from flowing farther up the wall.

In a preferred embodiment of the lower outlet, the passage diverter is located above the outlet diverter between the outlet diverter and the upper outlet. The frame of the lower outlet preferably includes a header adjacent the passage that provides a seat for a seal against which the passage diverter bears when it is disposed in its closed position to better prevent air from flowing to the upper outlet. If desired, the lower outlet can have more than two diverters or dampers, such as if it is desired to provide the capability to direct flow to other rooms.

The lower outlet is installed in a hole in the wall and preferably has a flange about its grill that abuts the wall and permits fasteners to fasten the flange to the wall. The upper outlet is similarly installed. The lower outlet preferably is located adjacent the floor and can be located at about floor level so as to efficiently distribute hot air into the room so it mixes well with the air already in the room. If desired, the lower outlet can be located in the floor preferably adjacent the wall.

The upper outlet preferably is located adjacent or at the ceiling so as to efficiently distribute cold air in the room so it mixes well with the air already in the room. If desired, the upper outlet can be located in the ceiling. If desired, the passage leading from the lower outlet can be connected to more than one upper outlet.

The passage is disposed within the wall and extends from the outlet port of the lower outlet to the inlet port of the upper outlet. In its preferred embodiment, the passage comprises the space defined between an existing front wall sheet, typically drywall, an existing rear wall sheet, also typically drywall, and a pair of spaced apart existing wall studs disposed between the sheets that space the front sheet from the rear sheet. Typically, the wall studs each comprise a metal or wooden 2×4. Where metal 2×4s are used, they should not have holes. If desired, the passage can comprise a separate duct received within the wall that extends from the lower outlet to the upper outlet.

The frame or housing of the upper and lower outlet can each or both be made up of a portion of a duct in the wall. For example, the outlet can have its grill or face plate attached or otherwise fastened to part of the wall, such as the studs within the wall, with part of the grill abutting outwardly extending flanges of a boot of a duct in the wall. The grill and at least the duct boot form the housing of the outlet. If desired, the grill can be fastened directly to the boot or to drywall that forms the exterior of the wall.

In a method of operation, during the heating season or when it is desired to heat the room, the passage diverter is closed and the outlet diverter is opened permitting hot air from the supply to be introduced into the room adjacent the floor where it will most efficiently mix with the air already in the room. During the cooling season or when it is desired to cool the room, the passage diverter is opened and the outlet diverter is closed to direct cool air up the passage and out the upper outlet where the cool air is introduced adjacent the ceiling where it will most efficiently mix with the air already in the room. Where it is desired not to heat or cool the room, the diverters can be both set in their closed positions thereby saving energy and minimizing the load on the heating system of the building or house.

Objects, features and advantages of the present invention include an air flow control apparatus that can be quickly and easily retrofitted to existing buildings and houses; is well suited for use in new construction; is simple and easy to operate; is versatile as it can be installed in buildings having either floor or lower wall outlets; is simple and easy to install because it does not require ductwork to be installed; is of compact construction as it does not take up room space; saves energy by distributing hot and cold air where it will most efficiently mix with the air in a room; and is of rugged, durable, lightweight, economical and simple construction.

Other objects, features, and advantages of the invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

DETAILED DESCRIPTION OF THE INVENTION

Figure 1:
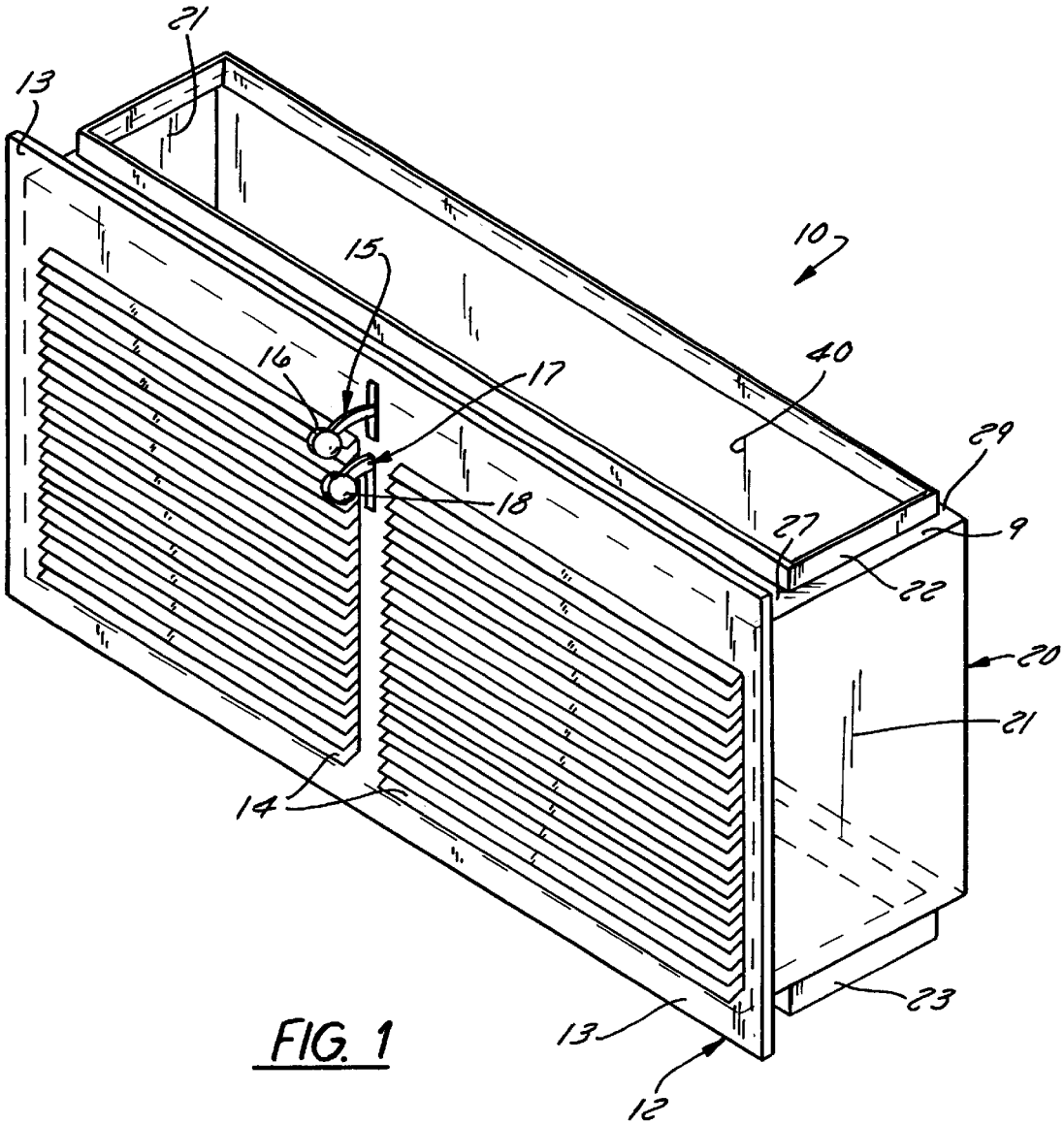
FIG. 1 is a perspective view of a flow control apparatus according to the present invention.

Referring initially to FIG. 1, an air flow apparatus 10 includes a body portion 12 having louvers or slots 14, preferably formed in a manner that directs air toward the floor of the room. Body portion 12 also includes a perimeter flange 13 for holding body portion 12 in an outlet of a room when mounted therein. The body portion 12 can be mounted or otherwise secured to the exterior drywall 24, 2×4s within the wall, and/or a portion of a duct 31 in the wall (FIG. 2B).

Figure 2B:
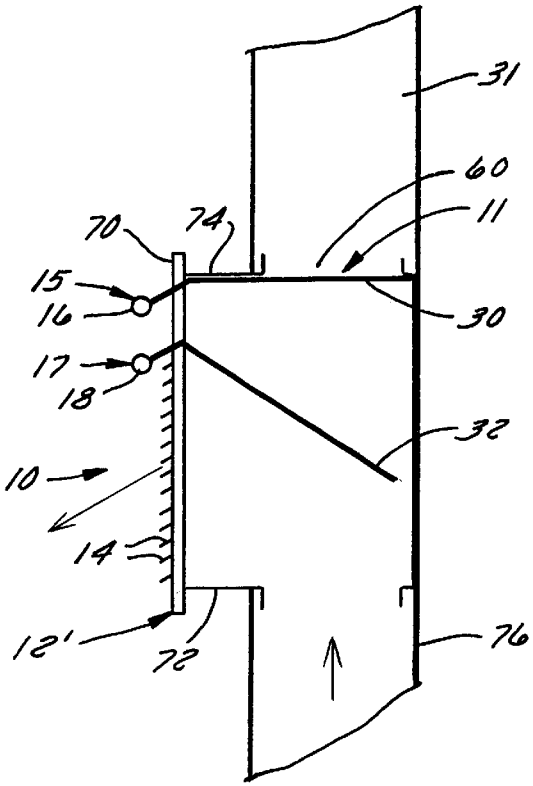
FIG. 2B is a partially broken away side view of the apparatus shown carried by a duct boot of a duct, such as a metal duct, that is located in the wall.
Figure 2A:
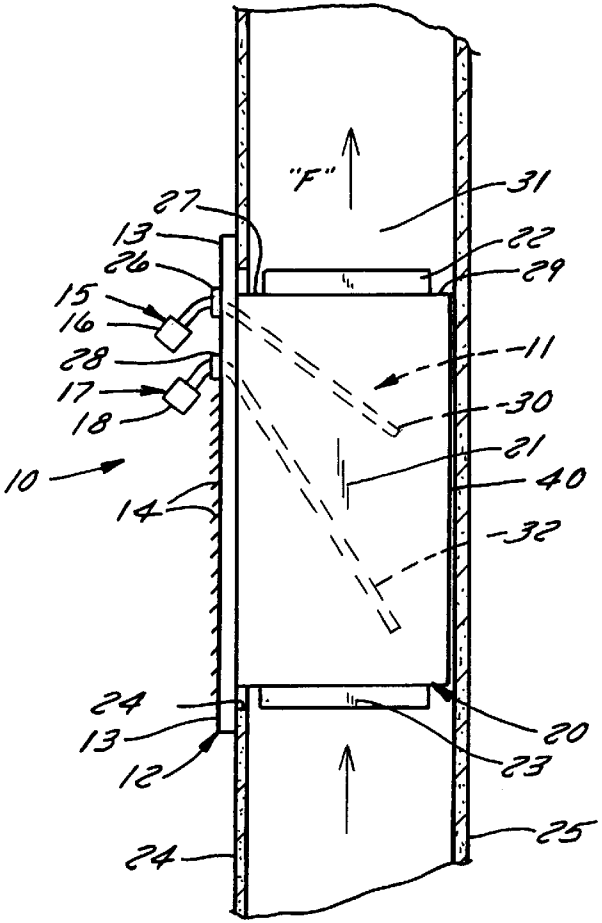
FIG. 2A is a partially broken away side view of the apparatus of FIG. 1, shown mounted in a wall.

Turning to FIG. 2A, air flow controller 11 is shown mounted in a wall outlet 21 formed in an interior-facing wall or sheet 24 such that perimeter flange 13 of body portion 12 abuts flush against wall 24 for connecting body portion 12 thereto. Air flow apparatus 10 includes a lower outlet that is a flow controller 11 which has first and second air diverters 30, 32, respectively, attached to a pair of first and second spaced manipulable diverter controllers 15, 17, respectively. Each diverter 30, 32 can be straight, curved, or otherwise bent. The upper diverter 30 can be bent so as to conform to the contour of the top of the duct or its housing 12 where it is needed for the diverter to close properly.

Preferably, the diverter controllers 15, 17 are levers that can be manually grasped and manipulated during operation. Also, each diverter controller 15, 17 has a handle 16, 18, respectively, that can be grasped and manipulated by a user (not shown) seeking to make an air flow adjustment. By operating diverter controllers 15, 17, the user can position air diverters 30, 32 to permit or impede air flow through louvers 14 and/or a passage 31, as described in further detail below.

Turning to FIG. 2B, the housing or body portion 12' can be comprised of a perforate grill or face plate 70 of the flow controller 11 that is carried by outwardly extending flanges 72 and 74 of a boot of a duct 31 within the wall. Duct 31 acts as a passage for conducting air flow within the wall between the flow controller 11 and upper outlet 60. Duct 31 also communicates air flow from supply 76 to the flow controller 11. Although the studs and drywall are not shown in FIG. 2B, the duct 31 is located within the wall between a pair of adjacent studs 36, 38 and between a pair of adjacent sheets of drywall 24, 25.

Figure 3:
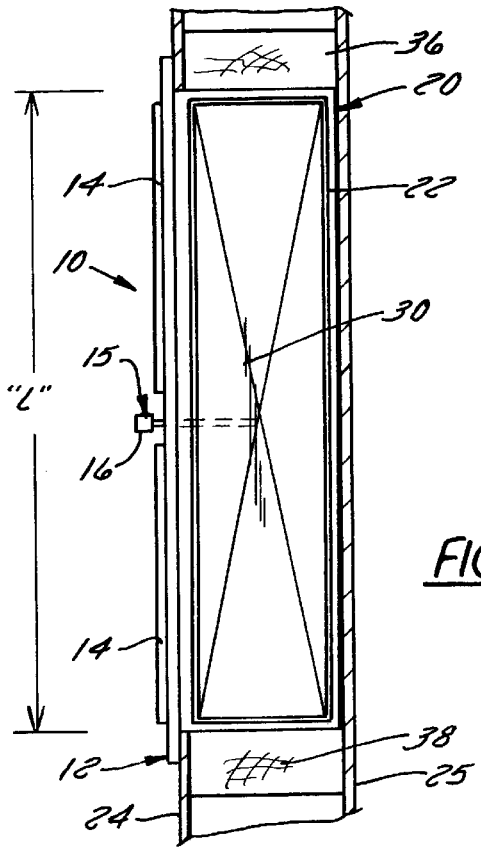
FIG. 3 is a partially broken away top view of the apparatus.
Figure 4:
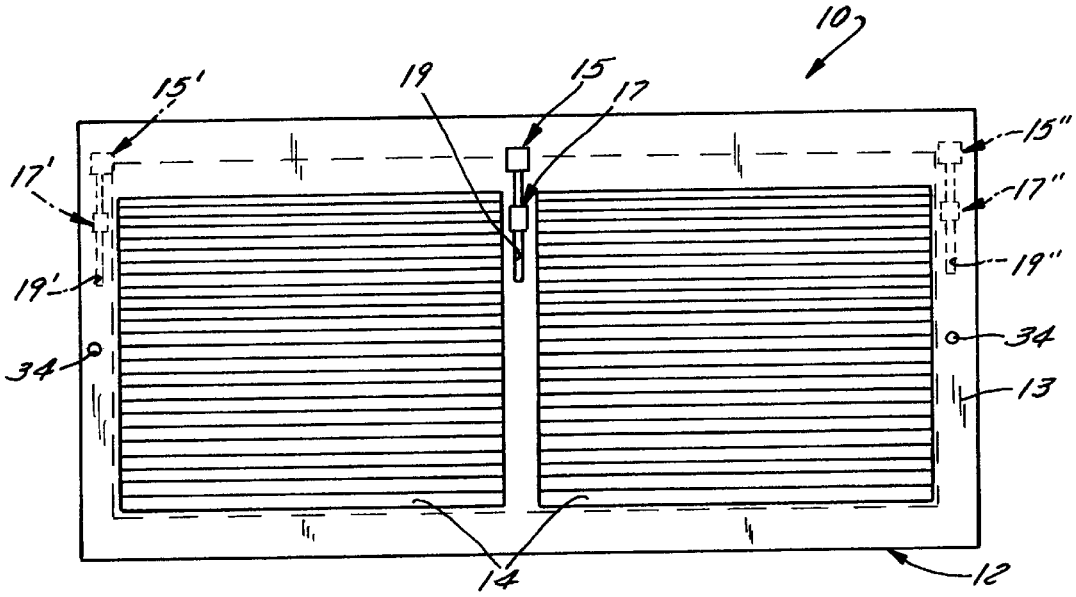
FIG. 4 is a front elevational view of the apparatus of FIG. 1.

Referring next to FIGS. 3 and 4, flow controller 11 of the air flow apparatus 10 of this invention is shown mounted between studs 36, 38, preferably wooden or metal 2×4 studs. Notably, body portion 12 has an inner length "L" (i.e., not including flange 13) corresponding approximately to the perpendicular distance between studs 36, 38 such that studs 36, 38, along with body portion 12 and back wall 25 collectively form the walls of an air flow duct that is in communication with the air supply. Flow controller 11 is used to control air flow through this duct. In FIG. 4, body portion 12 includes holes 34 for mounting the flow controller 11 to the wall, such as to studs, 36, 38 (FIG. 3) or a duct in the wall. Body portion 12 preferably also includes an opening 19 through which diverter controllers 15, 17 extend for ready manipulation by the user.

Referring to FIG. 4, if desired, diverter controller 15 or a pair of diverter controllers 15 can be located at the sides or flange 13 or 12 of the flow controller 11 with lower diverter controller 17 preferably located in the center. Such an arrangement preferably assures a simpler and better fit during installation of the flow controller 11. Where diverter controllers 15 and 17 are located near each other, they preferably are spaced apart sufficiently such that neither controller interferes with the operation of the other controller. Such a spaced apart arrangement also advantageously helps each diverter or damper clear the other diverter or damper when one is being moved relative to the other.

If desired, as shown in FIGS. 1, 2A, and 3, the flow controller 11 can also include a housing 20 having side walls 21 and a back wall 40. Housing 20 includes upper and lower perimeter flanges 22, 23, respectively, that extend generally away from housing 20 and generally parallel to the direction of air flow. Also flanges 22, 23 are spaced inwardly form the perimeter of housing 20 such that housing 20 includes a perimeter lip 9. Lip 9 includes a front section 27 and a rear section 29, each of which is used to support a seal (shown in FIGS. 5, 6, 7 and described below). Flanges 22, 23 are preferably used to connect air flow apparatus 10 to an existing duct contained within the wall. When mounted, back wall 40, is situated generally adjacent a rear wall or sheet 25. In operation, air flow from an air supply (not shown) travels upwardly through a passage 31 generally in a direction indicated "F" in FIG. 2A.

With further reference to FIGS. 2A, 2B, 3 and 4, each diverter controller 15, 17 is coupled, preferably pivotally, to body portion 12 of flow controller 11 such that upper and lower air diverters 30, 32, can be placed in a variety of positions. Flow controller 11 preferably also includes a pair of retaining devices 26, 28 each associated with a corresponding diverter controller 15, 17 for holding air diverters 30, 32 in a selected position. For example, retaining devices 26, 28 can comprise a friction fit coupling between diverter controllers 15, 17 and body portion 12 such that air diverters 30, 32 can be placed in nearly an infinite amount of positions. If desired, a detent structure may be implemented between diverter controllers 15, 17 and body portion 12 for the same purpose. As a result, the user can control the amount of air that is deflected or allowed to pass into the room.

Also, as shown in FIG. 4, although diverter controllers 15, 17 are preferably placed in an opening 19 situated between columns of louvers 14 for ready manipulation of air diverters 30, 32, diverter controllers 15, 17 may be coupled to body portion 12 at a variety of locations. In certain situations, it may be preferable to include an opening 19' for accommodating diverter controllers 15', 17', or to include opening 19" for accommodating diverter controllers 15", 17", depending upon which location is most accessible for the user. If desired, diverter controllers 15, 17 each can be attached to body portion 12, preferably grill 70, such that each extends through a different one of spaced openings, 19, 19', 19". Such an arrangement can allow each diverter controller 15, 17 to be manipulated over a larger range of motion without risk of interfering with the operation and movement of another diverter controller.

Figure 5:
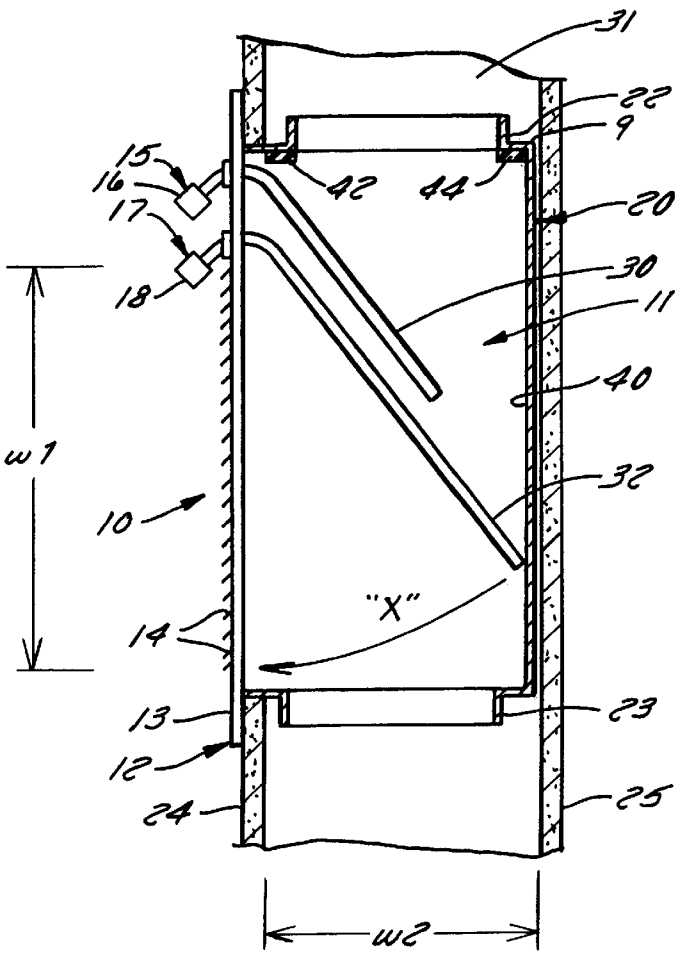
FIG. 5 is a partially broken away cross-sectional side elevational view of the apparatus of FIG. 1, including a flow control device.

As shown in FIG. 5, lower air diverter 32 has an approximate width "w1" that is sufficient to block air flow through louvers 14 when in a closed position (See FIGS. 7 and 8 and the corresponding discussion below). Upper air diverter 30 has a shape that conforms to the top of the housing so as to close properly and seal properly such that air flow is significantly impeded. Upper air diverter 30 is a passage diverter that has an approximate width "w2" that generally corresponds to the thickness of passage 31 (i.e., the perpendicular distance between walls 24 and 25) such that upper air diverter 30 substantially completely impedes air flow through passage 31 when it is located in a closed position (FIG. 2B). The lower air diverter 32 is an outlet diverter as it controls air flow out the front of the grill 70. Note that lower air diverter 32 is operable over a range defined by arc "x", that preferably is no greater than about 75° or 80°, while upper air diverter 30 is operable over a range approximately equal to 90°.

Figure 6:
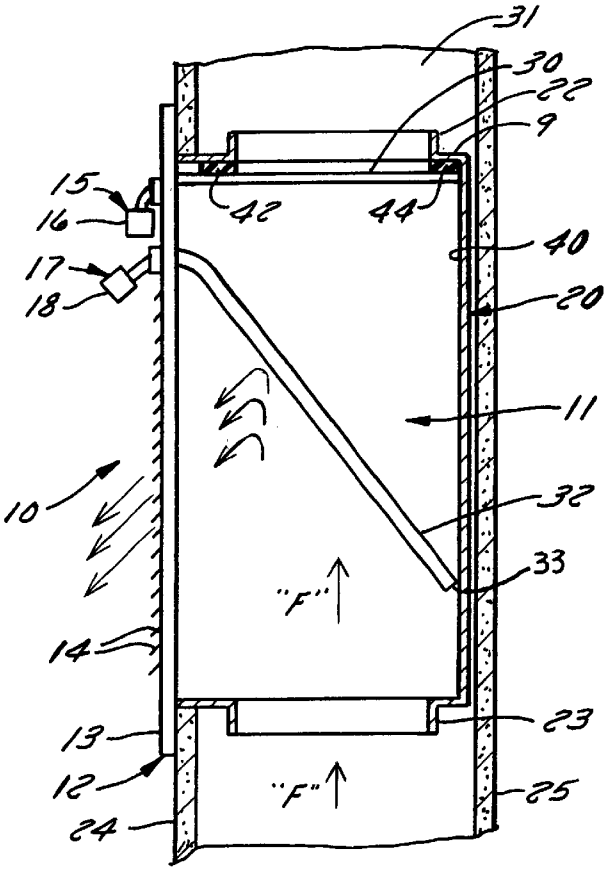
FIG. 6 is a partially broken away side elevational view of the apparatus of FIG. 1, showing the flow control device in a first position.
Figure 8:
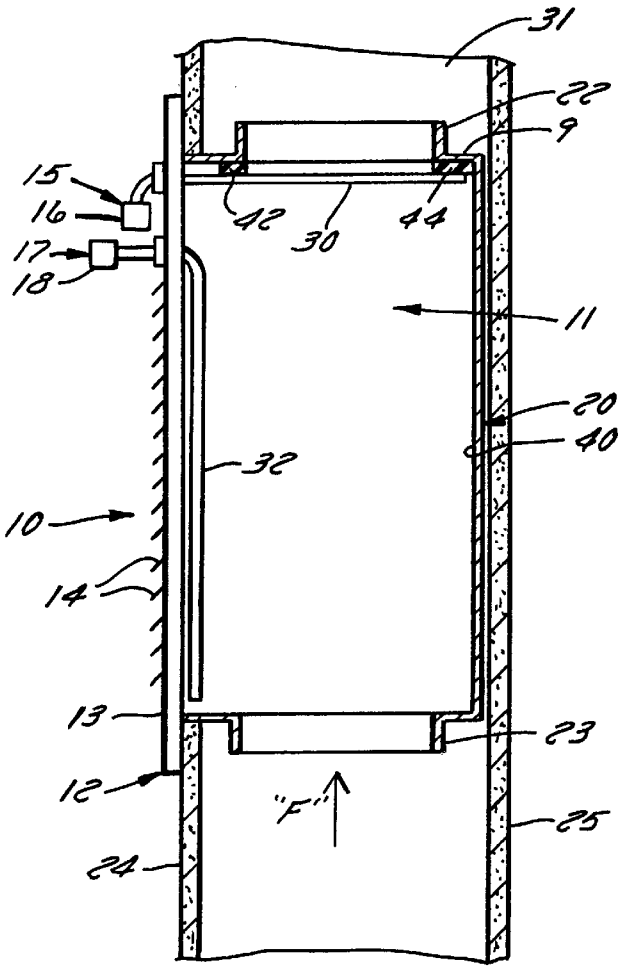
FIG. 8 is a view similar to FIG. 6, showing the flow control device in a third position.
Figure 7:
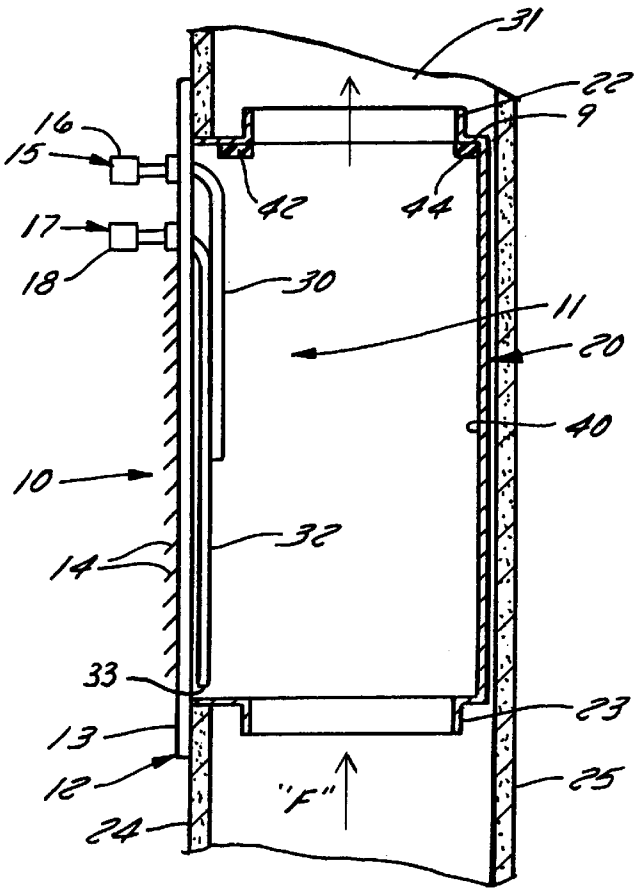
FIG. 7 is a view similar to FIG. 6, showing the flow control device in a second position.
Figure 9:
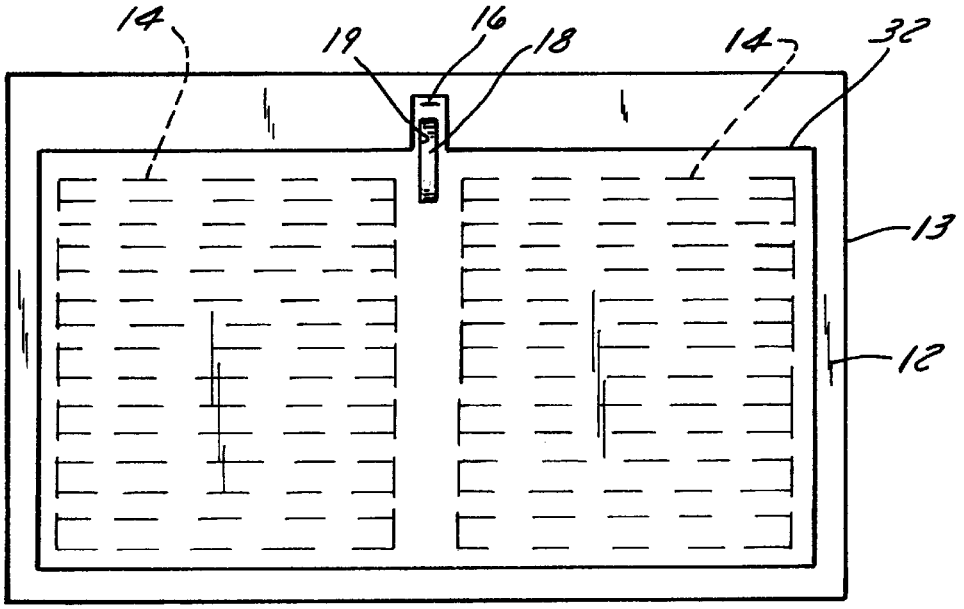
FIG. 9 is a rear elevational view of the body of the air flow apparatus of FIG. 1, showing a controller of the flow control device blocking air flow through the apparatus, i.e., as shown in FIGS. 7 & 8.

Turning to FIGS. 6, 7 and 8, other positions of upper diverter controller 15 and upper diverter 30 are shown, each one corresponding to an arrangement that provides the most efficient air distribution for a particular desired temperature or season. In FIG. 6, the diverters 30, 32 of the flow controller 11 are shown in a first setting for providing air, typically warm air during the heating season, through its louvers 14. To position the diverters 30, 32 such, the user manipulates upper diverter controller 15 (by pressing downwardly) to cause upper air diverter 30 to impede air flow "F" to and preferably through passage 31. In addition, the user manipulates lower diverter controller 17 by pressing downwardly on handle 18, such that lower air diverter 32 likewise impedes air flow "F" to passage 31 causing air to be directed out louvers 14, as shown in FIG. 6, and into the room. More particularly, the user presses downwardly on lever 18 until free edge 33 of lower air diverter 32 abuts rear wall 25 (alternatively, if included, back wall 40 of housing 20) thus providing redundant structure for better impeding air flow through passage 31. When in this fully opened position, both diverters 30, 32 act in concert to impede flow to passage 31 such that essentially a redundant seal is provided.

With further reference to FIGS. 5 and 6, air diverter 30 seals passage 31 when housing 20 is provided. In particular, forward and rear sections 27, 29, respectively, of housing lip 9 (FIG. 2) each include a seal 42, 44, respectively, attached to the underside thereof. Such a seal 42 and 44 can be composed of, for example, felt, sponge rubber, neoprene, nylon, polyurethane, silicone, polyethylene, VITON, KAPTON, or another suitable seal material.

When diverter controller 15 is pushed downwardly to cause upper air diverter 30 to block passage 31, a portion of the top surface of air diverter 30 presses against seals 42, 44 to provide a seal that impedes air flow, thus minimizing the amount of warm air that travels upwardly through passage 31 such that preferably virtually no air or a minimum of air travels upwardly. Preferably, the seal provided is substantially air-tight. When flow controller 11 is in this first setting, both air diverters 30, 32 prevent air flow "F" from rising within passage 31 while air diverter 32 diverts air flow through louvers 14 and into the room, thus heating the room in a more efficient manner. In sum, when the diverter controllers 15, 17 are in these aforementioned positions, a redundant seal is provided.

Preferably, flow controller 11, as shown in FIG. 6, is disposed in an opening or outlet in the wall that is situated near the floor of the room to allow warm air dispensed thereby to rise within the room such as is desired during the winter. Preferably, the wall outlet, and thus the flow controller 11 can be located no higher than about six inches above the floor to optimally distribute hot air into the room so that it efficiently mixes with the air already in the room.

In FIG. 7, flow controller 11 is shown in a second setting that allows air to flow through passage 31 toward the ceiling of the room. This arrangement is preferably implemented when cool air is desired, such as during the summer, and requires a wall outlet disposed near the ceiling which preferably includes a register mounted therein (see FIG. 10). The register 56 can be equipped with a single diverter or damper that is movable between an open position that permits air to flow through the register 56 and a closed position that impedes flow through the register 56. A flexible magnetic vent cover (not shown) can be placed over the louvers or register grill perforations to impede flow whether or not the register is equipped with a damper or diverter. Preferably, the outlet and register 56 can be located no lower than about six inches below the ceiling to help ensure optimal distribution of cool air introduced into the room so it more efficiently mixes with air already into the room.

To place flow controller 11 in this second setting, the user lifts both diverter controllers 15, 17 upwardly. As a result, neither air diverter 30, 32 blocks air flow "F" through passage 31 while both diverters 30, 32, and primarily lower air diverter 32, block air flow "F" through louvers 14 of flow controller 11. In other words, air flow "F" is allowed to propagate toward the ceiling of the room so that cool air may be dispensed through the ceiling outlet into the room. Preferably, the flow controller 11 near the floor and the register 56 near the ceiling are spaced apart at least about four feet to help facilitate efficient distribution of hot or cool air into the room, depending, of course, on the position of diverter controllers 15 and 17.

When no air flow into the room is desired, the flow controller 11 has third setting, as is shown in FIG. 8. In particular, the user pushes downwardly on diverter controller 15 to cause upper air diverter 30 to block upward air flow "F" through passage 31. Next, the user lifts upwardly on lower diverter controller 17, thus causing lower air diverter 32 to block air flow through louvers 14 of flow controller 11.

As mentioned above, when housing 20 is included, air diverter 30 seals passage 31 by abutting seals 42, 44 attached to flanges 27, 29, respectively. However, when housing 20 is not included, air diverter 30 still provides redundant structure for efficiently blocking air flow upwardly through passage 31. As such, air flow into the room is substantially completely blocked, thus allowing the conditioned air to be cost-effectively diverted to other rooms of the building or house. Preferably, flow controller 11 always includes a housing or a portion of a duct in the wall.

Figure 10:
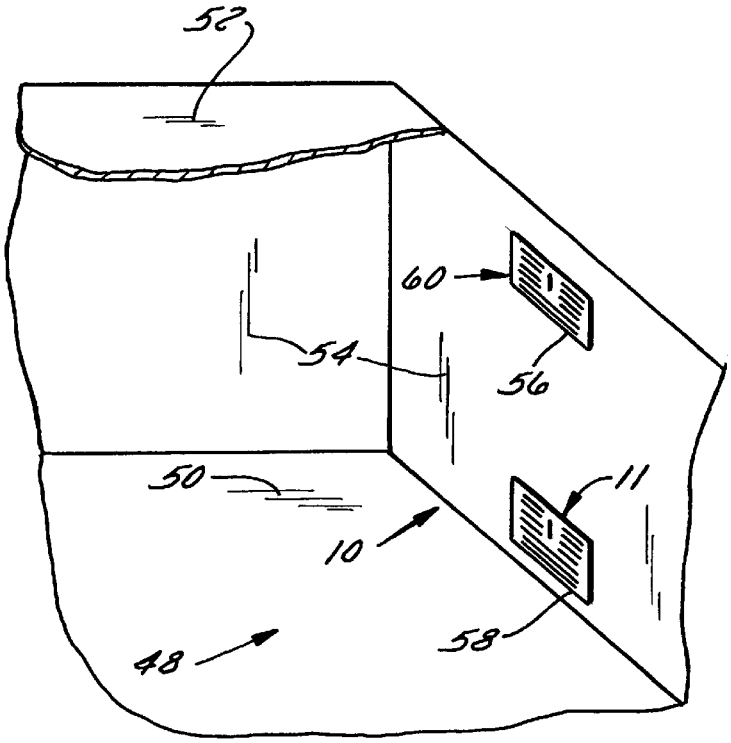
FIG. 10 is a perspective view of a room including the air flow apparatus of FIG. 1 disposed at a lower outlet, and a register disposed at an upper outlet.

Turning to FIG. 10, a room 48 having a ceiling 52, a floor 50 and walls 54 is shown including lower outlet 58 adjacent floor 50 and upper outlet 60 adjacent ceiling 52. Also included are a flow controller 11 of the flow control apparatus 10 according to the present invention mounted in floor outlet 58 and a register 56, that can be a conventional register, mounted on upper wall outlet 60. Preferably, apparatus 10 is positioned as follows. In summer, when cool air is desired, the user places flow controller 11 in the second setting as shown in FIG. 7, wherein flow controller 11 impedes air flow through louvers 14 of air flow apparatus 10 and permits air flow through passage 31 upwardly toward upper wall outlet 60 such that it may be dispensed by an appropriately opened register 56. As a result, air flow apparatus 10 permits efficient cooling of room 48 by only allowing the cool air to flow through upper ceiling outlet 60 and fall within the room, and preventing cool air from being dispensed through lower outlet 58, i.e., near the floor of the room where cool air typically will inefficiently stagnate.

Conversely, in the winter when warm air is desired, the user places flow controller 11 in the first setting, as shown in FIG. 6, such that the heated air flows entirely through louvers 14 of apparatus 10 at floor outlet 58. In doing so, warm air is allowed to rise within the room, more efficiently heating the room. By providing the redundant structure described above, flow controller 11 maximizes the warm air that flows out its louvers or grill by preventing warm air from rising upwardly through passage 31 where it would be less useful for heating the room. Overall, flow controller 11 and register 56 make up a air flow apparatus 10 of this invention that can be installed integral within a wall, is retrofittable to an existing floor outlet formed in a wall of a building, and can be readily operated to provide efficient distribution of conditioned air into a room, no matter which season.

Note that although apparatus 10, and particularly flow controller 11, is preferably manually controllable to keep the overall cost of manufacture as low as possible, it should be appreciated that apparatus 10 can be implemented in a system whereby the flow controller 11 is controlled automatically. For instance, retaining devices 26, 28 can be provided with solenoid actuators that are electrically coupled to a thermostat associated with the air supply that is responsive to thermostat control signals indicative of particular thermostat settings. More particularly, in response to signals output by the thermostat, the solenoid actuators appropriately position the first and second air diverters, as described previously, for the most efficient distribution of cool/warm conditioned air. Such an arrangement can be coupled to a programmable thermostat that controls the positions of the different dampers at different times of the day.

When cool air is introduced, it preferably has a temperature of no lower than about ten degrees Fahrenheit cooler than the temperature of the air in the room. Preferably, air no cooler than about 65° F. and no warmer than about 85° F. is introduced into the room when it is desired to cool the room. When hot air is introduced, it preferably has a temperature of no greater than about ten degrees hotter than the temperature of the air in the room. Preferably, air having a temperature of between about 68° F. and about 80° F. is introduced into the room when it is desired to heat the room.

The air flow control apparatus 10 of this invention can be used in conjunction with two, or even more, upper in-wall outlets or in-wall registers 60 in communication with a common in-wall lower register 11, if desired. The invention can also be used where the bottom register 11 is disposed in the floor or in communication with a different floor-disposed outlet or register. Where a room has an existing floor register, a separate duct can be used to communicate air to the wall and the upper and lower registers 60 and 11. Where the invention is to be used in larger rooms, ceiling headers and the like can be removed or cut away to more evenly duct air flow from the ceiling into the larger room over a greater region. If desired, a flexible magnetic vent cover (not shown) can be used to cover the grill of either register 10 and/or 60 to better seal the register when it is desired that no air flow through the register.

It is also to be understood that, although the foregoing description and drawings describe and illustrate in detail at least one working embodiment of the present invention, to those skilled in the art to which the present invention relates, the present disclosure will suggest many modifications and constructions as well as widely differing embodiments and applications without thereby departing from the spirit and scope of the invention. The present invention, therefore, is intended to be limited only by the scope of the appended claims.

I claim:

1. An apparatus for controlling air flow from an air-conveying passage through a first opening formed in a wall of a room, said air-conveying passage extending from a floor of said room to a ceiling of said room, said air-conveying passage communicating with an air supply adjacent said floor of said room, said apparatus comprising:

a body portion carried by said wall adjacent said first opening in said wall, and said body portion having a first perforate outlet abutting the wall and overlying said first opening in said wall through which air from said air-conveying passage can flow through said first opening in said wall into said room;

a selectively positionable air flow control device carried by said body portion that is comprised of a pair of selectively positionable air diverters and disposed in said wall, said flow control device for impeding air flow through said outlet and from said air-conveying passage when said selectively positionable air diverters are disposed in a first position, impeding air flow through said outlet and permitting air flow through an air connecting passage in said wall toward said ceiling of said room when said selectively positionable air diverters are disposed in a second position, and impeding air flow from said air-conveying passage and permitting air flow through said first outlet when said selectively positionable air diverters are disposed in a third position;

a manipulable control mechanism disposed in said room that is operably associated with said selectively positionable air flow control device, wherein said manipulable control mechanism is used in positioning said selectively positionable air flow control device, and wherein said manipulable control mechanism comprises a pair of manipulable controllers with one of said manipulable controllers operably coupled to a first one of said selectively positionable air diverters and another one of said manipulable controllers operably coupled to a second one of said selectively positionable air diverters;

a second perforate outlet overlying a second opening in said wall, wherein said second perforate outlet and said second opening are both disposed above said first opening in said wall; and wherein said connecting passage is disposed inside said wall and extends vertically from said first outlet to said second outlet.

2. An apparatus as defined in claim 1, wherein said selectively positionable air diverters are spaced apart.

3. An apparatus as defined in claim 2, wherein said pair of manipulable controllers are spaced apart.

4. An apparatus as defined in claim 1, wherein each said air diverter is pivotally coupled to said body portion via said corresponding controller.

5. An apparatus as defined in claim 4, wherein a retaining device is provided at the pivotal coupling point of each air diverter for holding said air diverter at a selected position.

6. An apparatus as defined in claim 5, wherein said body portion includes at least one opening for receiving a lever of a corresponding one of said controllers such that a user can manually manipulate said lever to control the position of a corresponding air diverter.

7. An apparatus as defined in claim 1, wherein said pair of selectively positionable air diverters comprises:

a first one of said selectively positionable air diverters adapted to impede air flow through said passage when said selectively positionable air diverters are disposed in either said first position or said third position, and a second one of said selectively positionable air diverters adapted to impede air flow through said body portion outlet when said selectively positionable are diverters are disposed in said second position.

8. An apparatus as defined in claim 4, wherein said first diverter is rotatable over a range approximately equal to 90°.

9. An apparatus as defined in claim 1, further including a housing attached to said body portion, said housing having a plurality of side walls and an open top and an open bottom, and said housing disposed in said wall.

10. An apparatus as defined in claim 9, wherein a free edge of one of said air diverters bears against one of said side walls of said housing when in said third position to provide a redundant seal between said air diverters and said side wall.

11. An apparatus as defined in claim 1 wherein each air diverter comprises an imperforate, solid and generally rectangular plate.

12. An apparatus as defined in claim 1 wherein the wall further comprises a pair of spaced apart studs inside the wall and wherein said connecting passage comprises a duct in the wall disposed between said studs.

13. An apparatus as defined in claim 12 wherein the wall further comprises a front sheet disposed inside the room and a rear sheet wherein said front and rear sheet sandwich said studs and said duct is defined by said front sheet, said studs and said rear sheet and has a generally rectangular cross section.

14. An apparatus as defined in claim 1 wherein each said selectively positionable air diverter comprises an imperforate damper in said wall, wherein one of said dampers has a first position that obstructs flow of air out said first outlet and a second position that obstructs flow of air through said air connecting passage and wherein the other one of said dampers has a first position that does not obstruct flow of air through said air connecting passage and a second position that obstructs flow of air through said air connecting passage, wherein both of said dampers are disposed in said first position when air having a temperature cooler than the temperature of air in the room is flowing through said air-conveying passage out said second outlet and into said room, wherein both of said dampers are disposed in said second position when air having a temperature warmer than the temperature of air in said room is flowing through said air-conveying passage out said first outlet and into said room, and wherein said one of said dampers is disposed in said first position and the other one of said dampers is disposed in said second position to oppose air in the air-conveying passage from flowing into said room.

15. An apparatus according to claim 14 further comprising a seal disposed in the wall against which one of said dampers abuts when one of said dampers is disposed in one of said first and second positions.

16. An apparatus for controlling air flow from an air-conveying passage in a wall of a room through a first opening formed in said wall that is disposed adjacent a floor of said room, said air-conveying passage being in air flow communication with an air supply adjacent said floor of said room, said apparatus comprising:

a body portion carried by said wall and having an outlet through which air can pass through said first opening of said air-conveying passage into said room, said body portion disposed adjacent said first opening of said air-conveying passage;

first and second selectively positionable air diverters spaced from each other, said first and second selectively positionable diverters disposed in said wall, and said first and second diverters carried by said body portion, wherein said air diverters affect air flow through both said outlet and said air-conveying passage, said first air diverter is adapted to impede air flow through said air-conveying passage when said first air diverter is disposed in a first position permitting air to flow out of said first opening and said first air diverter is adapted to impede air flow out of said first opening when said first air diverter is disposed in a second position, said second diverter is adapted to impede air flow through said air-conveying passage when said second diverter is disposed in a first position;

a perforate grill carried by said wall and overlying a second opening in said wall that is disposed above said first opening in the wall; and a connecting passage in said wall that is disposed downstream of said air-conveying passage, said connecting passage extending from said first opening to said second opening and said second diverter is adapted to permit air to flow in said connecting passage toward said second opening in the wall when said second diverter is disposed in a second position and said first diverter is disposed in said first position.

17. An apparatus as defined in claim 16, further including first and second diverter controllers coupled to said first and second air diverters, respectively, each said diverter controller for manually controlling the position of a corresponding one of said first and second air diverters.

18. An apparatus as defined in claim 16, wherein said wall further comprises a pair of spaced apart studs with one of said studs disposed on one side of said first and second selectively positionable air diverters and the other one of said studs disposed on the other side of said first and second selectively positionable air diverters, a front drywall sheet disposed adjacent said room and disposed against said studs, and a rear drywall sheet spaced from said front drywall sheet and disposed against said studs; and wherein said connecting passage is formed by said studs, said front drywall sheet, and said rear drywall sheet.

19. An apparatus as defined in claim 18, wherein said connecting passage comprises a duct.

20. A system for controlling air flow from an air-conveying passage into a room having first and second outlets that communicate with said air-conveying passage, said air-conveying passage in communication with an air supply adjacent said second outlet of said room, said first outlet being disposed adjacent a ceiling of the room, said second outlet being disposed adjacent a floor of the room, and said air-conveying passage extending vertically within a wall from said first outlet to said second outlet, said system comprising:

a ceiling register mounted over said first outlet and having an upper damper for controlling air flow through said ceiling register;

a floor register mounted over said second outlet and having a selectively positionable air flow control device for controlling air flow through said floor register and said air-conveying passage, said selectively positionable air flow control device comprises a pair of spaced apart and rotatable dampers; and wherein said selectively positionable air flow control device, when said pair of spaced apart and rotatable dampers are disposed in a first position, permits air flow through said floor register and impedes air flow through said air-conveying passage, and wherein said selectively positionable air flow control device, when said pair of spaced apart and rotatable dampers are disposed in a second position, impedes air flow through said floor register and permits air flow through said air-conveying passage to said ceiling register, and wherein said selectively positionable air flow control device, when said pair of spaced apart and rotatable dampers are disposed in a third position, impedes air flow through both said floor register and said air-conveying passage passage.

21. A system as defined in claim 20, wherein said spaced apart and rotatable dampers are pivotally mounted to said floor register, said ceiling register is carried by said ceiling, and said floor register is carried by said floor.

22. A register for controlling air flow from an air-conveying passage through an opening formed in a wall of a room, said register comprising:

a body portion disposed in said wall adjacent said opening in said wall and having a first outlet in air flow communication with said opening in said wall through which air can flow into said room and a second outlet in air flow communication with an air duct disposed in said wall, said second outlet located downstream of said air-conveying passage and disposed higher in said room than said first outlet;

a first selectively positionable and imperforate damper pivotally mounted to said body portion adjacent said first outlet and said first selectively positionable and imperforate damper disposed in said body portion;

a second selectively positionable and imperforate damper spaced from said first selectively positionable and imperforate damper that is pivotally mounted to said body portion and which can be moved independently of said first selectively positionable and imperforate damper, said second selectively positionable and imperforate damper disposed in said body portion adjacent said first outlet;

at least one controller operably connected to one of said first and second selectively positionable and imperforate dampers, said at least one controller enabling at least one of said first and second selectively positionable and imperforate dampers to be positioned, at least a portion of said at least one controller disposed in the room;

wherein said first selectively positionable and imperforate damper selectively positionable is movable between a first position where said first selectively positionable and imperforate damper obstructs air flow through said air duct and a second position wherein said first selectively positionable and imperforate damper obstructs flow through said first outlet;

wherein said selectively positionable and imperforate second damper is movable between a first position where said second selectively positionable and imperforate damper obstructs flow through said air duct and a second position disposed away from said first position;

wherein said first and second selectively positionable and imperforate dampers both obstruct flow through said air duct at the same time when both of said selectively positionable and imperforate dampers are disposed in said first position, said first and second selectively positionable and imperforate dampers permit flow through said air duct when both of said first and second selectively positionable and imperforate dampers are disposed in or adjacent said second position, and flow through said first outlet and through said air duct is obstructed when said first selectively positionable and imperforate damper is disposed in said second position and said second selectively positionable and imperforate damper is disposed in said first position.

23. An apparatus for controlling a flow of air from an air supply into a room having a floor, a ceiling, a wall, and a vertically extending passage disposed in said wall, said vertically extending passage communicating with said air supply and extending from adjacent said floor to adjacent said ceiling, said apparatus comprising:

a) an upper outlet disposed adjacent said ceiling that is in air flow communication with said vertically extending passage and which has a perforate grill overlying said upper outlet;

b) a lower outlet disposed adjacent said floor that is in air flow communication with said vertically extending passage and includes 1) a first damper disposed in said vertically extending passage that is movable between i) a closed position impeding air from said air supply from flowing out said lower outlet into said room and ii) an open position disposed from said closed position permitting air from said air supply to flow through said lower outlet into said room, 2) a second damper disposed in said vertically extending passage that is movable between i) a closed position impeding air from the air supply from flowing farther up said vertically extending passage toward the upper outlet and ii) an open position disposed from said closed position permitting air from said air supply to flow farther up said vertically extending passage to said upper outlet, and a perforate grill overlying said lower outlet;

c) a first handle connected to said first damper, said first handle having a portion disposed in said room that is manually movable to position said first damper; and d) a second handle connected to said second damper, said second handle having a portion disposed in said room that is manually movable to position said second damper.

24. An apparatus for controlling a flow of air from an air supply into a room having a wall, a floor, and a ceiling, comprising:

a) a lower register carried by the wall and disposed adjacent the floor having 1) a housing with i) an inlet within the wall for accepting air from the air supply, ii) a perforate grill in air flow communication with the room, and iii) a discharge port within the wall that is disposed above the inlet through which air from the air supply can pass, 2) a first damper received in the housing having a handle adjacent the grill for being manipulated between a closed position impeding air from the air supply from flowing through the grill and an open position disposed from the closed position permitting air from the air supply from flowing through the grill into the room, and 3) a second damper received in the housing having a handle adjacent the grill for being manipulated between a closed position impeding air from the air supply from flowing out the discharge port and an open position disposed from the closed position permitting air from the air supply from flowing out the discharge port;

b) an upper register carried by the wall and disposed adjacent the ceiling above the lower register and having 1) an inlet in the wall in air flow communication with the discharge port of the lower register for accepting air from the air supply when the second damper is disposed in an open position, and 2) a perforate grill in air flow communication with the room;

c) wherein 1) flow of air from the air supply is directed out the grill of the lower register into the room adjacent the floor when the first damper is disposed in an open position, 2) flow of air from the air supply is directed out the discharge port of the lower register to the upper register when i) the first damper is disposed in its closed position and ii) the second damper is disposed in an open position, and 3) flow of air from the air supply is impeded i) to the second register and ii) through the grill of the first register when i) the first damper is disposed in its closed position and ii) the second damper is disposed in its closed position; and d) wherein the upper register is spaced from the lower register and when the first damper is disposed in its closed position and the second damper is disposed in an open position air from the air supply flows out the discharge port of the lower register within the wall to the inlet of the upper register.

25. An apparatus as defined in claim 24 further comprising a duct in the wall in communication with the discharge port of the lower register and the inlet of the upper register.

26. An apparatus as defined in claim 24 wherein when the first damper is disposed in its closed position and the second damper is disposed in an open position, flow of air from the air supply is directed out the grill of the upper register into the room adjacent the ceiling.

27. An apparatus as defined in claim 25 wherein the wall comprises a plurality of spaced apart and vertically extending supports and wherein the lower register, the upper register, and the duct are disposed between a plurality of the supports.

28. An apparatus as defined in claim 27 wherein the wall further comprises a front sheet disposed on one side of the plurality of the supports and which overlies the plurality of the supports, a rear sheet disposed on another side of the plurality of the supports and which overlies the plurality of the supports, and wherein the duct is defined by the space between the front sheet, the rear sheet, and the plurality of the supports.

29. An apparatus as defined in claim 28 wherein the first sheet and the second sheet are each comprised of drywall and each of the supports comprise an elongate stud.

30. An apparatus as defined in claim 28 wherein the duct comprises a conduit received in the wall and disposed between the front sheet, the rear sheet and the plurality of the supports.

31. A method of controlling air flow from an air supply into a room having a floor, a ceiling and a plurality walls, at least one of said walls having a first air-conveying outlet disposed near said floor and an associated second air-conveying outlet disposed near said ceiling, said second outlet being in air flow communication with said first outlet via a passage inside said at least one of said walls, said passage in communication with said air supply, said method comprising with steps of:

(a) providing a floor register mounted to one of said walls adjacent said first outlet and having a body portion that extends into said one of said walls and a selectively positionable air flow control device disposed in said one of said walls for controlling air flow through both said floor register and said passage, said selectively positionable air flow control device comprising a pair of independently movable dampers;

(b) providing a second register mounted to said one of the walls adjacent said second outlet;

(c) positioning said flow control device in a first position by moving at least one of said pair of independently movable dampers so as to permit air flow through said floor register and impede air flow through said passage when said air flow is warm air flow;

(d) positioning said flow control device in a second position by moving at least one of said pair of independently movable dampers so as to impede air flow through said floor register and permit air flow upwardly through said passage such that said air flow is in communication with said second outlet when the air flow is cool air flow; and (e) positioning said flow control device in a third position by moving at least one of said pair of independently movable dampers so as to impede air flow through both said floor register and said passage when it is desired to impede air flow into said room.

32. A method according to claim 31, wherein said pair of independently movable dampers are spaced apart and pivotally mounted to said body portion and disposed in said wall.

33. A method according to claim 26 wherein said flow control device is positioned in said first position in step (c) by moving at least one of said pair of independently movable dampers to enable warm air flow to be introduced through said floor register, said warm air flow having a temperature of no greater than about ten degrees warmer than the temperature of air in the room, and wherein said flow control device is positioned in said second position in step (d) by moving at least one of said pair of independently movable dampers to enable cool air flow to be introduced through said second register adjacent said ceiling, said cool air flow having a temperature of no lower than about ten degrees cooler than the temperature of air in said room.

34. A method according to claim 26 wherein the position of said pair of independently movable dampers of said flow control device is automatically controlled.

* * * * *